United States Patent [19]

Janssen et al.

[11] 4,145,052

[45] Mar. 20, 1979

[54] GOLFING IRON WITH WEIGHT ADJUSTMENT

[76] Inventors: Robert L. Janssen, 900 S. 6th Ave., Space 246, Hacienda Heights, Calif. 91450; Lee M. Bucholz, 10230 Hopeland Ave., Downey, Calif. 90241

[21] Appl. No.: 793,383

[22] Filed: May 3, 1977

[51] Int. Cl.[2] ..... A63B 53/04

[52] U.S. Cl. ..... 273/171

[58] Field of Search ..... 273/77 R, 78, 167–174

[56] References Cited

U.S. PATENT DOCUMENTS

| | | | |
|---|---|---|---|
| 1,453,503 | 5/1923 | Holmes | 273/171 |
| 1,518,316 | 12/1924 | Ellingham | 273/171 |
| 1,529,009 | 3/1925 | Carpenter | 273/171 X |
| 1,840,924 | 1/1932 | Tucker | 273/171 |
| 2,067,556 | 1/1937 | Wettlaufer | 273/171 X |
| 2,360,364 | 10/1944 | Reach | 273/171 |
| 3,075,768 | 1/1963 | Karns | 273/171 X |
| 3,191,936 | 6/1965 | Guier | 273/171 X |
| 3,466,047 | 9/1969 | Rodia et al. | 273/171 |
| 3,845,960 | 11/1974 | Thompson | 273/171 |
| 3,897,066 | 7/1975 | Belmont | 273/171 |
| 3,979,122 | 9/1976 | Belmont | 273/171 |

FOREIGN PATENT DOCUMENTS

| | | | |
|---|---|---|---|
| 347502 | 4/1931 | United Kingdom | 273/171 |
| 440379 | 12/1935 | United Kingdom | 273/171 |

*Primary Examiner*—Richard J. Apley

*Attorney, Agent, or Firm*—John T. Matlago

[57] ABSTRACT

A metal head for an iron-type golf club is provided with a pair of elongated chambers disposed end-to-end within the lower longitudinal portion thereof. The pair of chambers are respectively disposed in the toe and heel half portions of the head. A pair of threaded apertures are provided on the sole of the head for communicating with the respective chambers. A threaded closure member is fitted within each aperture. Initially, each of the chambers is half filled with a heavy metal powder substantially greater in density than the density of the head metal. By adding, subtracting or interchanging varying amounts of the metal powder in the chambers, the center of mass of the head and, therefore, the center of the sweet spot on the striking face thereof, can be shifted about in any direction over a working zone.

9 Claims, 5 Drawing Figures

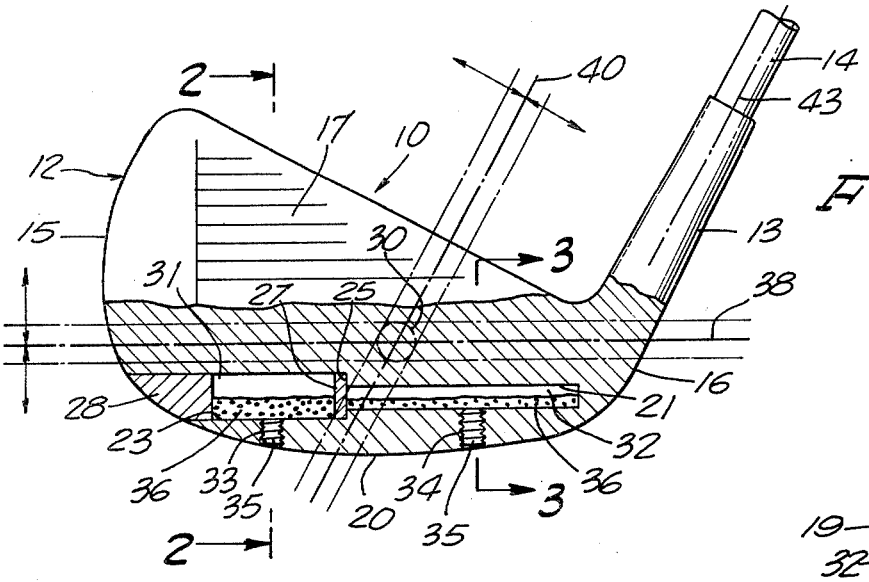
FIG. 1.
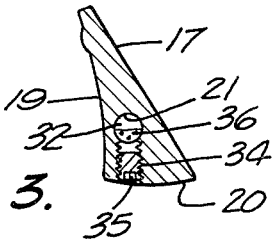
FIG. 3.
FIG. 2.
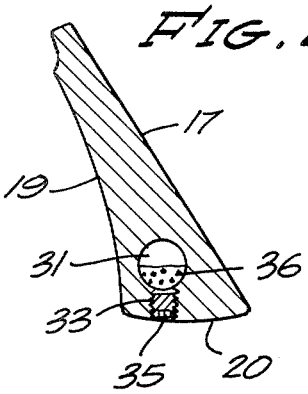
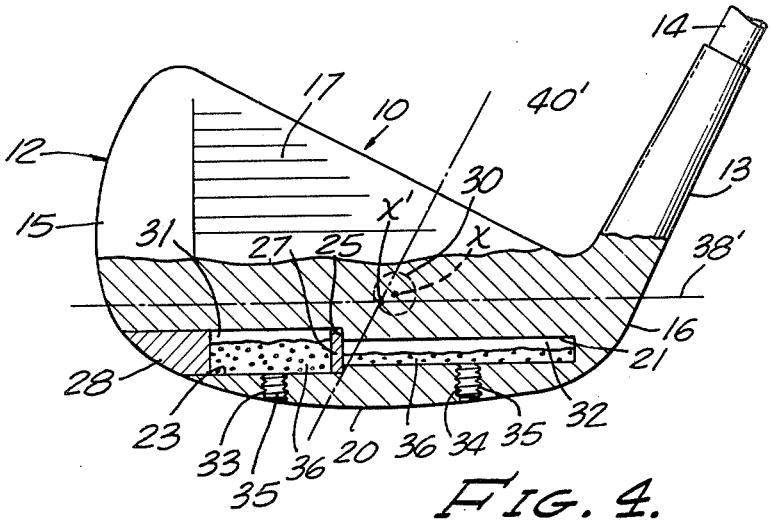
FIG. 4.
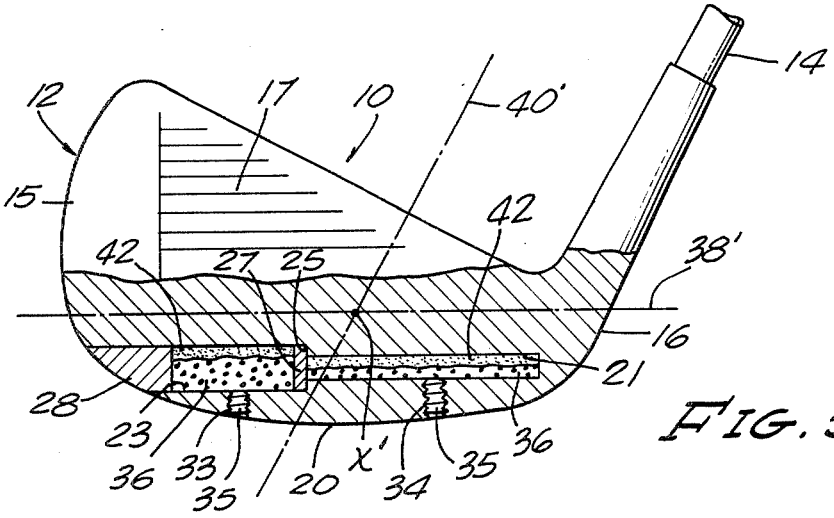
FIG. 5.

GOLFING IRON WITH WEIGHT ADJUSTMENT

BACKGROUND OF THE INVENTION

This invention relates to golf clubs and more particularly to the construction of a head of an iron-type golf club to enable the user to readily adjust its weight and balance to meet his own particular needs and desires.

It is well known in the game of golf to add or subtract weights to the heads of golf clubs to accomodate the physique and playing habits of the individual players. Thus, when the weight distribution of the club head is not suited for the player's natural mode of play, there is an increased probability that the head will strike the ball off-center, i.e., off the center of mass or sweet spot on the face of the club, resulting in shots that are off-line. Another affect of the weight distribution of the head not being suited to the player's individual style is that it diminishes the total impact between the club face and the ball since the maximum impact is obtained when the ball is hit on the sweet spot of the club head. It is thus evident that it is highly desirable to provide for constructing the head of a golf iron such that a player is able to experiment with and readily adjust the weight and balance thereof to his personal satisfaction.

SUMMARY OF THE INVENTION

The metal head of the golfing iron of the present invention has a pair of elongated chambers disposed end-to-end within the lower longitudinal portion thereof. One of the chambers is located in the toe half and the other in the heel half of the head. Threaded apertures are provided on the bottom of the head for communicating with each of the chambers. A threaded closure member is fitted within each aperture. By removing the threaded closure members, each chamber is initially half filled with a metal powder having a substantially greater density than the head metal. When so filled, the center of mass of the head results in the center of the sweet spot being initially located at a given point in the center of a working zone on the striking face of the head. Now then, by adding, subtracting or interchanging the heavy metal powder in the two chambers, the center of the sweet spot of the head may be shifted any amount desired and in any direction in the working zone from its initial position. It should be especially noted that the use of a heavy metal powder for weighting purposes permits the center of mass of the head and therefore the sweet spot on the striking face to be minutely relocated not only toward the heel or toe ends but also upwardly or downwardly from its initial position.

Accordingly, one of the objects of the present invention is to provide an improved and simplified means for adjusting the weight and balance of a head for an iron-type golf club.

Another object of the present invention is to provide a metal head for a golfing iron which can be easily adjusted to relocate the center of sweet spot about a working zone provided on the striking face thereof.

Another object of the present invention is to provide a head construction for a golfing iron which permits a minute adjustment of its center of mass to be made within a working zone in any direction from a given initial position.

Still another object of the present invention is to provide a head for a golfing iron whose center of mass can be slightly shifted about as desired by adding, removing or interchanging a heavy metal powder in each of two elongated chambers respectively provided in the toe and heel halves of the head.

These and other objects, features, and advantages of the present invention as well as a better understanding and comprehension thereof can be obtained from the following specification when taken in conjunction with the accompanying drawings.

BRIEF DESCRIPTION OF THE DRAWINGS

FIG. 1 is an elevation view of the golfing iron head of the present invention looking from the face side and with the lower portion thereof in section;

FIG. 2 is a sectional view taken along line 2—2 of FIG. 1;

FIG. 3 is a sectional view taken along line 3—3 of FIG. 1;

FIG. 4 is an elevation view of the golfing iron head similar to FIG. 1 showing the center of mass of the head having been shifted downwardly and toward the toe end thereof; and FIG. 5 is an elevation view of the golfing iron head of FIG. 4 showing that a lighter powder has been added to fill each of the chambers to capacity.

DETAILED DESCRIPTION OF THE INVENTION

Referring to the drawings, a typical iron-type golf club 10 is shown having a head 12 and a hosel 13. A shaft 14 is fitted on the hosel 13. The head includes a toe end 15, a heel end 16, a planar striking face 17 and a rear surface 19 which is recessed inwardly. The lower portion of the head is thickened or enlarged throughout its length, as illustrated in FIGS. 2 and 3, such as to provide a relatively wide sole 20.

The enlarged lower portion of the head 12 has a longitudinally extending bore 21 drilled or otherwise formed therein which extends from the toe end 15 toward the heel end 16 but stops short of passing through the heel end. The diameter of the toe end 15 portion of the bore 21 is then enlarged to provide the configuration of a counterbore 23 which extends inwardly to a point adjacent the longitudinal center of the head and forms a shoulder 25. A flat disc 27 formed of brass is then fitted in the larger diameter bore 23 so as to rest against the shoulder 25 and is bonded in position. An end plug 28 formed of brass is then inserted in the toe end 15 of the counterbore 23. The outer surface of the end plug 28 is shaped to match the contour of the toe end 15 of the head.

It should now be clear that the disc 27 and the end plug 28 close off the ends of the bore 21 and the counterbore 23 to form elongated chambers 31 and 32 in the respective toe and heel end halves of the head. A first aperture 33 is drilled through the sole 20 of the head 12 to open into the center of the toe chamber 31 and a second aperture 34 is drilled through the sole 20 of the head to open into the center of the heel chamber 32. These apertures 33 and 34 are threaded to receive Allen head set screws 35 which serve to close off the apertures when advanced such that their outer ends are flush with the sole 20 of the club head, as shown in FIGS. 2 and 3.

It should be noted that although the toe chamber 31 is shorter in length than the heel chamber 32 it has a larger diameter than chamber 32. Thus, the chambers are made to be equal in volume and of a predetermined size. By use of the threaded apertures 33 and 34 each of the chambers 31 and 32 has introduced therein a heavy metal powder 36, for example, a tungsten powder, having a substantially greater density than the density of the head metal. The volume of each of the chambers 31 and 32 is such that it can hold three to four grams of the heavy metal powder 36 when filled. Preferably when a player first uses the golf club, as illustrated in FIG. 1, enough heavy metal powder 36 is initially introduced into each of the apertures 33 and 34 to only half fill the chambers 31 and 32. Note that the heavy metal powder 36 lays on the bottom or lower half of the chambers 31 and 32 when the golf club is positioned for use by the player.

As shown in FIG. 1, with each of the chambers 31 and 32 half filled with the heavy metal powder 36, the center of mass X for the head 12 is defined by the intersection of a horizontal axis 38 which bisects the mass of the head 12 and an oblique axis 40 which passes through the point X and is parallel to the axis 42 of the shaft 14 fitted on the hosel 13.

It should now be clearly understood that when the golf club 10 is initially used by the player, the projection of the center of mass X on the striking face 17 of the head is selected as the contemplated point of impact with the golf ball and this point is commonly referred to as the sweet spot.

It should now be evident that when the golf club is swung it is desirable to maintain the striking face 17 of the head 12 normal to the direction of motion of the downswing so that at the instant of impact with the ball the striking face is square with the direction in which the head is traveling. It is also desirable that a plane normal to the center of the ball passes normally through the center of the sweet spot on the striking face 17 of the head. When this happens, the total weight and weight distribution or balance of the weight of the head 17 is considered to be proper for the swing form and physique of the golfer, resulting in iron shots that tend to be consistently straight and of the same distance, as desired.

However, if the total weight and distribution of the weight of the head is not proper for the natural swing form and physique of the player, the striking face 17 of the head 12 will have an off-center point of impact with the ball which will create a tendency for the club face to pivot about the off-center point of inpact. Thus, when the ball is impacted by the club head on one side or the other of the sweet spot, the ball will have a tendency to hook, slice or fade. Likewise, when the ball is impacted by the club head above or below the sweet spot, the ball will not have the desired lift and impact causing the trajectory and distance to be off.

It should be appreciated that the failure to obtain the proper point of impact between the club face and the ball can be the result of apparently small and inconsequential adjustments of the total weight and/or distribution of weight of the head. Thus the use of a heavy metal powder for weighting a club head is of great advantage since it permits for such very small adjustments to be made.

It should now be evident that by use of the golf club of the present invention the center of mass X of the head 12 can be minutely shifted as desired by adding or subtracting any amount of the heavy metal powder 36 into or out of the two chambers 31 and 32. Thus, to shift the center of mass from the point X shown in FIG. 1 closer to the heel end 16 of the club head, a selected amount of the heavy metal powder 36 is withdrawn from chamber 31 and introduced into chamber 32. In a similar manner to shift the center of mass from the point X shown closer to the toe end 15 of the club head, a selected amount of the heavy metal powder 36 is withdrawn from chamber 32 and introduced into chamber 31.

As previously pointed out, the heavy metal powder 36 preferably initially only half fills each of the chambers 31 and 32. Thus, it should now be further evident that by removing powder from both these chambers 31 and 32, for example, the lower portion of the head 12 will be lightened in weight and the center of mass X or the center of the sweet spot will be shifted upwardly on the striking face 17. Likewise, by adding more heavy metal powder 36 into both these chambers, for example, the center of mass X or the center of the sweet spot will be shifted downwardly on the striking face.

Thus by minutely varying the amounts of the metal powder in each of the chambers 31 and 32, the center of mass and therefore the center of the sweet spot can be shifted to any point and in any direction within the working zone 30 indicated by the dotted line surrounding the point X on the striking face 17 of the head 12 (FIG. 1).

It should now be clear that if in the course of a game of golf a player notes that with his normal swing he tends to slice or hook the ball when he uses the golf club of the present invention, or if he notes that he is not getting the desired lift on the ball, for example, he will be given a positive indication of how he should adjust the weight distribution of the head 12 to bring the center of the sweet spot thereon in contact with the ball. Now then, by removing the Allen head screws 35 from the apertures 33 and 34, he can then simply add, subtract or interchange a small amount of the heavy metal powder 36 in the two chambers 31 and 32 such that the location of the center of the sweet spot on the striking face 17 of the iron head can be shifted slightly in the proper direction about the working zone 30.

Thus, assuming that the player when using the golfing iron 10 tends to slice the ball during a round of golf, he may, by adding a small amount of heavy metal powder 36 in the toe chamber 31, as illustrated in FIG. 4, relocate the center of mass to the point X'. This causes the horizontal axis 38 to be shifted downwardly to a new location 38' and the oblique axis 40 to be shifted laterally toward the toe end 15 of the head 12 to a new location 40'. The player can then play another round of golf using his adjusted golfing iron 10 and from his performance can determine whether the adjustment of the balance of the head 12 has helped to improve his game. He may gradually add additional small amounts of the heavy metal powder 36 to the chamber 31 over the period of several rounds of golf, each time noting if his performance has improved.

It should now be clearly understood that the elongated chambers 31 and 32 are located within the heel end and toe end half portions of the head, respectively, such that by adding or subtracting or interchanging the heavy metal powder 36 in minute amounts in the two chambers, the actual center of mass of the club head may be shifted slightly in any direction about its initial point X in the working zone 30, to the end that the impact with the ball when the golfer uses his normal swing will be obtained on the center of the sweet spot on the club face.

As shown in FIG. 5, after the proper amount of heavy metal powder 36 has been placed in the two chambers 31 and 32 to provide the desired total weight distribution, as indicated by the player being satisfied with the weight adjustment he has made to the club, a light weight filler powder 42 of considerably less density material than the head metal, for example, aluminum, may be added to each of the chambers 31 and 32 to fill it to capacity without appreciably affecting the swing weight or balance weight of the club head. Note that the heavy metal powder 36 will settle toward the bottom of the chamber and remain therein while the light filler powder 42 remains in the upper portion thereof.

It should be especially noted that the chambers 31 and 32 are located in the lower portion of the head 12, i.e., well below the horizontal axis 38 which bisects the mass of the head. Thus the introducing of the heavy metal powder into this lower region of the head helps to move the head through the ball on impact so as to give it the desired lift and trajectory.

While the preferred embodiment of the device as described herein is well adapted to fulfill the objects and advantages previously mentioned as desirable, it is to be understood that the invention is not limited to the specific features shown and described but that the means and configuration herein disclosed are susceptible of modification in form, proportion and arrangement of parts without departing from the principle involved or sacrificing any of its advantages and the invention is therefore claimed in embodiments of various forms all coming within the scope of the claims which follow.

What is claimed is:

1. In an iron-type golf club;

a metal head having a heel, a toe, a thickened lower portion and a striking face for a golf ball;

said head having a pair of axially aligned elongated chambers respectively disposed in the toe and heel half portions of the thickened lower portion and having threaded apertures in the bottom of said thickened lower portion leading to each of said elongated chambers;

a threaded closure member fitted within each of said apertures; and a metal powder having a density substantially greater than the density of the head metal carried in each of the chambers;

whereby the center of mass of the head may be shifted about a working zone by introducing into or withdrawing from said chambers varying amounts of said metal powder.

2. In an iron-type golf club, a metal head having a heel, a toe, a thickened lower portion, a sole and a striking face for a golf ball;

said head having an elongated recess hole located in the thickened lower portion thereof and extending inwardly from the toe toward the heel thereof;

a disc secured within said recess hole in the central vicinity of said head and an end plug fitted on the toe end of said recess hole to thereby form a pair of elongated chambers respectively disposed in the toe and heel halves of the thickened lower portion thereof;

the sole of said head being provided with threaded apertures through which a metal powder having a density substantially greater than the density of the metal head may be introduced or withdrawn from each of said chambers; and a threaded closure member fitted within each of said apertures;

whereby the center of mass of the head may be shifted about a working zone by introducing into or withdrawing from said chambers varying amounts of said metal powder.

3. The iron-type golf club of claim 2 wherein said threaded closure members have the form of Allen screws.

4. The iron-type golf club of claim 2 wherein said chambers are of equal volume.

5. The iron-type golf club of claim 2 wherein the cross section of the chamber formed in the heel half of the thickened lower portion has a smaller diameter than that of the chamber formed in the toe half thereof to thereby provide a central annual shoulder within the head; and wherein said disc is secured to lie against said shoulder.

6. In an iron-type golf club, a metal head having a heel, a toe, a thickened lower portion, a sole and a striking face for a golf ball;

said head having an elongated recess hole located in the thickened lower portion thereof and extending inwardly from the toe toward the heel thereof;

a disc secured within said recess hole in the central vicinity of said head and an end plug fitted on the toe end of said recess hole to thereby form a pair of elongated chambers respectively disposed in the toe and heel halves of the thickened lower portion thereof, the sole of said head being provided with threaded apertures leading to each of said chambers;

a threaded closure member fitted within each of said apertures; and a quantity of metal powder having a density substantially greater than the density of the head metal carried in each of said chambers;

whereby the center of mass of the head may be shifted about a working zone by introducing into or withdrawing from said chambers varying amounts of said metal powder.

7. The iron-type golf club of claim 6 wherein each of said chambers is initially half filled with said metal powder.

8. The iron-type golf club of claim 6 wherein each of said chambers is only partly filled with said metal powder; and wherein the remaining capacity of each of said chambers is filled with a powder formed of a material which is of substantially less density than the density of the head metal.

9. The iron-type golf club of claim 6 wherein said metal powder is formed of tungsten.

* * * * *